US011319664B2

(12) United States Patent
Chang et al.

(10) Patent No.: US 11,319,664 B2
(45) Date of Patent: May 3, 2022

(54) CLOTHES CARE APPARATUS

(71) Applicant: Samsung Electronics Co., Ltd., Suwon-si (KR)

(72) Inventors: Sung Ho Chang, Suwon-si (KR); Yong Joon Jang, Suwon-si (KR); Jae Ryong Park, Suwon-si (KR); Kwon Chul Yun, Suwon-si (KR); Ju Yeong Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 186 days.

(21) Appl. No.: 16/568,594

(22) Filed: Sep. 12, 2019

(65) Prior Publication Data

US 2020/0080254 A1 Mar. 12, 2020

(30) Foreign Application Priority Data

Sep. 12, 2018 (KR) ..... 10-2018-0109234

(51) Int. Cl.
*D06F 73/02* (2006.01)
*D06F 39/08* (2006.01)
(Continued)

(52) U.S. Cl.
CPC ..... *D06F 73/02* (2013.01); *D06F 39/083* (2013.01); *D06F 39/088* (2013.01); *D06F 58/10* (2013.01); *D06F 58/203* (2013.01); *D06F 58/24* (2013.01)

(58) Field of Classification Search
CPC ..... D06F 39/083; D06F 58/10; D06F 39/088; D06F 58/24; D06F 73/02; D06F 58/203
See application file for complete search history.

(56) References Cited

U.S. PATENT DOCUMENTS 3,752,373 A 8/1973 Smith
2006/0101588 A1* 5/2006 Park ..... D06F 35/00 8/158
(Continued)

FOREIGN PATENT DOCUMENTS

KR 10-2008-0065754 7/2008
KR 10-2009-0050621 5/2009
(Continued)

OTHER PUBLICATIONS

International Search Report dated Feb. 25, 2020, in corresponding International Patent Application No. PCT/KR2019/011751.
(Continued)

*Primary Examiner* — Benjamin L Osterhout
(74) *Attorney, Agent, or Firm* — Staas & Halsey LLP

(57) ABSTRACT

A clothes care apparatus includes a body including a clothes care compartment and a machine room arranged under the clothes care compartment, a steam generation device configured to generate steam, a steam injector including a steam injection port configured to receive the steam from the steam generation device and inject the steam into an inside of the clothes care compartment, and a condensed water outlet configured to discharge condensed water from the steam into the inside of the clothes care compartment, and a drain hole provided in the clothes care compartment below the condensed water outlet to connect the clothes care compartment to the machine room so as to allow the condensed water discharged from the condensed water outlet to flow into the machine room.

20 Claims, 11 Drawing Sheets

(51) Int. Cl.

| | |
|---|---|
| ***D06F 58/10*** | (2006.01) |
| ***D06F 58/24*** | (2006.01) |
| ***D06F 58/20*** | (2006.01) |

(56) References Cited

U.S. PATENT DOCUMENTS

2006/0117596 A1* 6/2006 Kim ..... D06F 33/65 34/607
2007/0227030 A1* 10/2007 Oh ..... D06F 25/00 34/60
2008/0040867 A1 2/2008 Wong et al.
2008/0282750 A1* 11/2008 Yang ..... D06F 39/008 68/5 C
2009/0113745 A1* 5/2009 Choi ..... D06F 39/008 34/139
2009/0119955 A1* 5/2009 Hong ..... D06F 58/10 38/14
2009/0151205 A1* 6/2009 Kim ..... D06F 58/10 38/2
2009/0228156 A1* 9/2009 Hong ..... D06F 73/02 700/300
2009/0241269 A1* 10/2009 Yoo ..... D06F 73/02 8/149.3
2009/0241606 A1* 10/2009 Yoo ..... D06F 73/02 68/5 C
2009/0260250 A1* 10/2009 Moon ..... D06F 58/10 34/202
2009/0320313 A1* 12/2009 Bae ..... D06F 58/203 34/132
2010/0146805 A1* 6/2010 Kim ..... D06F 58/20 34/201
2010/0218566 A1* 9/2010 Moon ..... D06F 58/10 68/5 C
2013/0198970 A1* 8/2013 Doh ..... D06F 58/02 8/137
2016/0177489 A1* 6/2016 Ahn ..... D06F 39/04 68/5 C
2016/0177497 A1 6/2016 Choi et al.
2016/0177498 A1* 6/2016 Park ..... D06F 58/24 68/5 C
2018/0223470 A1 8/2018 Yoon et al.

FOREIGN PATENT DOCUMENTS

| | | |
|---|---|---|
| KR | 10-1366273 | 2/2014 |
| KR | 10-2015-0137191 | 12/2015 |
| KR | 10-1597108 | 2/2016 |

OTHER PUBLICATIONS

Extended European Search Report for European Application No. 19858781.8 dated Jul. 21, 2021 (11 pages).

* cited by examiner

CLOTHES CARE APPARATUS

CROSS-REFERENCE TO RELATED APPLICATION(S)

This application is based on and claims priority under 35 U.S.C. § 119 to Korean Patent Application No. 10-2018-0109234, filed on Sep. 12, 2018, in the Korean Intellectual Property Office, the disclosure of which is incorporated by reference herein in its entirety.

BACKGROUND

1. Field

The disclosure relates to a clothes care apparatus, and more particularly, to a clothes care apparatus capable of managing clothes using airflow.

2. Description of the Related Art

In general, a clothes care apparatus refers to a device for washing or drying laundry. In the clothes care apparatus, a clothes care apparatus having a drying function is provided with a hot air supplier that supplies hot air to an accommodation space where clothes are accommodated for drying, and a steam generator configured to perform a refresh function such as crease removal, deodorization, and static removal of clothes.

The clothes care apparatus is configured in the form of a cabinet in which a storage compartment for storing clothes is formed. The storage compartment for storing clothes is formed in an upper portion of the cabinet and an electronics compartment in which a steam generator and a hot air supplier are placed is formed under the storage compartment. The storage compartment and the electronics compartment may be separated from each other by a partition wall.

The clothes care apparatus may have a clothes support member provided in the storage compartment for mounting the clothes. The clothes care apparatus may take care of clothes by translational and/or rotational movement of the clothes support member, or take care of the clothes by providing airflow to the clothes support member.

SUMMARY

Therefore, it is an aspect of the disclosure to provide a clothes care apparatus capable of guiding condensed water, which is generated by a steam injector, to a water drain tank by using a simple configuration.

Additional aspects of the disclosure will be set forth in part in the description which follows and, in part, will be apparent from the description, or may be learned by practice of the presented embodiments.

In accordance with an aspect of the disclosure, a clothes care apparatus includes a body including a clothes care compartment and a machine room arranged under the clothes care compartment, a steam generation device configured to generate steam, a steam injector including a steam injection port configured to receive the steam from the steam generation device and inject the steam into an inside of the clothes care compartment, and a condensed water outlet configured to discharge condensed water from the steam into the inside of the clothes care compartment, and a drain hole provided in the clothes care compartment below the condensed water outlet to connect the clothes care compartment to the machine room so as to allow the condensed water discharged from the condensed water outlet to flow into the machine room.

The clothes care apparatus may further include a guide plate provided in the clothes care compartment below the condensed water outlet to guide the condensed water discharged from the condensed water outlet to the drain hole.

The condensed water outlet may be inclined downward toward the clothes care compartment.

The steam injector may include a bottom surface inclined upward toward the clothes care compartment.

The steam injector may include a stem nozzle in which the steam injection port and the condensed water outlet are formed, a nozzle cover coupled to the steam nozzle, and a first sealing member arranged between the steam nozzle and the nozzle cover.

The steam injection port may be arranged above the condensed water outlet.

The guide plate may include a first guide inclined downward toward the drain hole and configured to guide the condensed water discharged from the condensed water outlet to the drain hole, and a second guide configured to guide the condensed water from the drain hole to a duct arranged inside the machine room.

The duct may include a first duct connected to a first airflow inlet into which the air of the clothes care compartment flows into the first duct, and a second duct connected to the first duct and to a first airflow outlet configured to discharge the air from the second duct to the clothes care compartment.

The duct may include a communication port configured to connect the first duct to the second duct, and a connecting member to connect the first duct to the second duct to drain condensed water from the second duct, to the first duct.

The clothes care apparatus may further include a water drain tank arranged inside the machine room and connected to the first duct to collect condensed water from the first duct.

A first end of the guide plate may be coupled to the steam injector and a second end of the guide plate may be coupled to the second duct.

The clothes care apparatus may further include a second sealing member arranged between the steam injector and the body.

The guide plate may include a recessed guide groove to form a water channel configured to guide the condensed water discharged from the condensed water outlet to the machine room.

The guide plate may include a plurality of protruding guide ribs to form a water channel configured to guide the condensed water discharged from the condensed water outlet to the machine room.

The clothes care apparatus may further include a plate cover configured to cover a flow of the condensed water in the guide plate.

In accordance with an aspect of the disclosure, a clothes care apparatus includes a body including a clothes care compartment, a machine room arranged under the clothes care compartment, and a drain hole provided in the clothes care compartment below the condensed water outlet to connect the clothes care compartment to the machine room, a steam generation device configured to generate steam, a steam injector including a steam injection port configured to receive the steam from the steam generation device and inject the steam into an inside of the clothes care compartment, and a condensed water outlet configured to discharge condensed water, which is generated from the steam, into the inside of the clothes care compartment, and a guide plate provided below the condensed water outlet and including a first guide configured to guide the condensed water discharged from the condensed water outlet to the drain hole.

The condensed water outlet may be inclined downward toward the clothes care compartment.

The clothes care apparatus may further include a duct arranged in the machine room and configured to circulate air in the clothes care compartment, and the guide plate may further include a second guide configured to extend from the first guide to the duct.

The clothes care apparatus may further include a water drain tank connected to the duct and arranged in the machine room so as to collect condensed water from the duct.

In accordance with an aspect of the disclosure, a clothes care apparatus includes a body including a clothes care compartment and a machine room arranged under the clothes care compartment, a steam generation device configured to generate steam, a steam injector configured to receive the steam from the steam generation device and to inject the steam into an inside of the clothes care compartment, a duct arranged in the machine room and configured to circulate air in the clothes care compartment, and a guide plate provided in the clothes care compartment below the steam injector and configured to guide condensed water discharged from the steam injector, to the duct.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
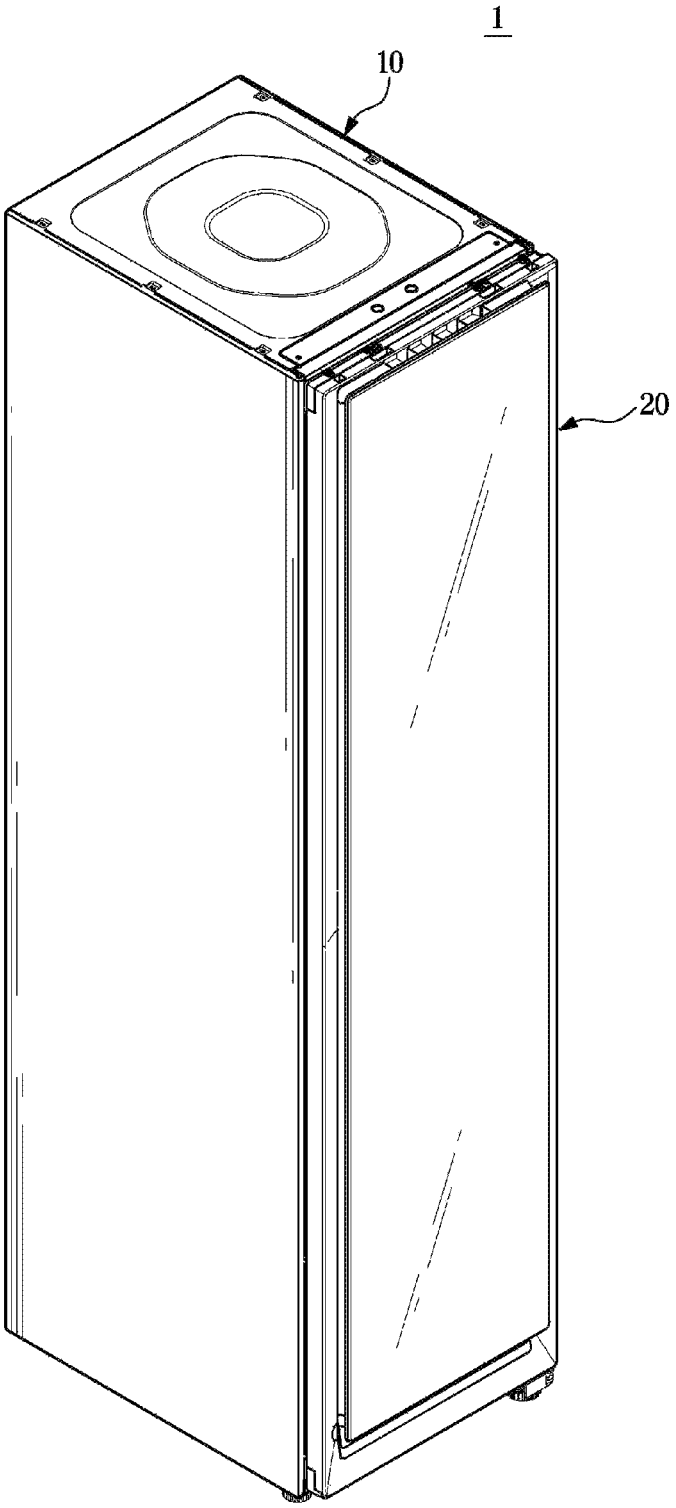
FIG. 1 is a view of a clothes care apparatus according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

Also, like reference numerals or symbols denoted in the drawings of the present specification represent members or components that perform the substantially same functions.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "left side", "right side" and the like may be defined by the drawings, but the shape and the location of the component is not limited by the term.

The disclosure will be described more fully hereinafter with reference to the accompanying drawings.

Figure 2:
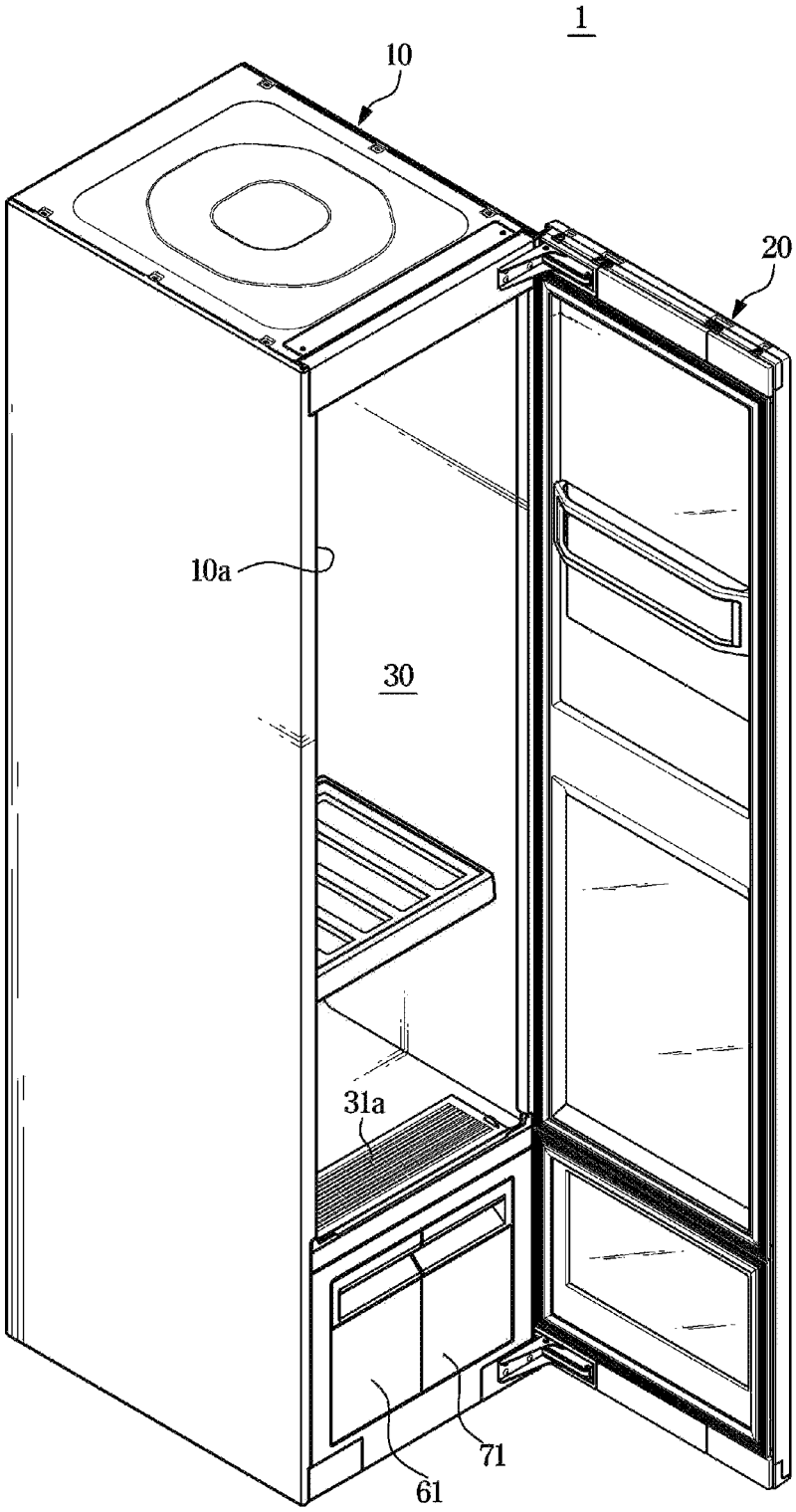
FIG. 2 is a view illustrating a state in which a door of the clothes care apparatus of FIG. 1 is opened.
Figure 3:
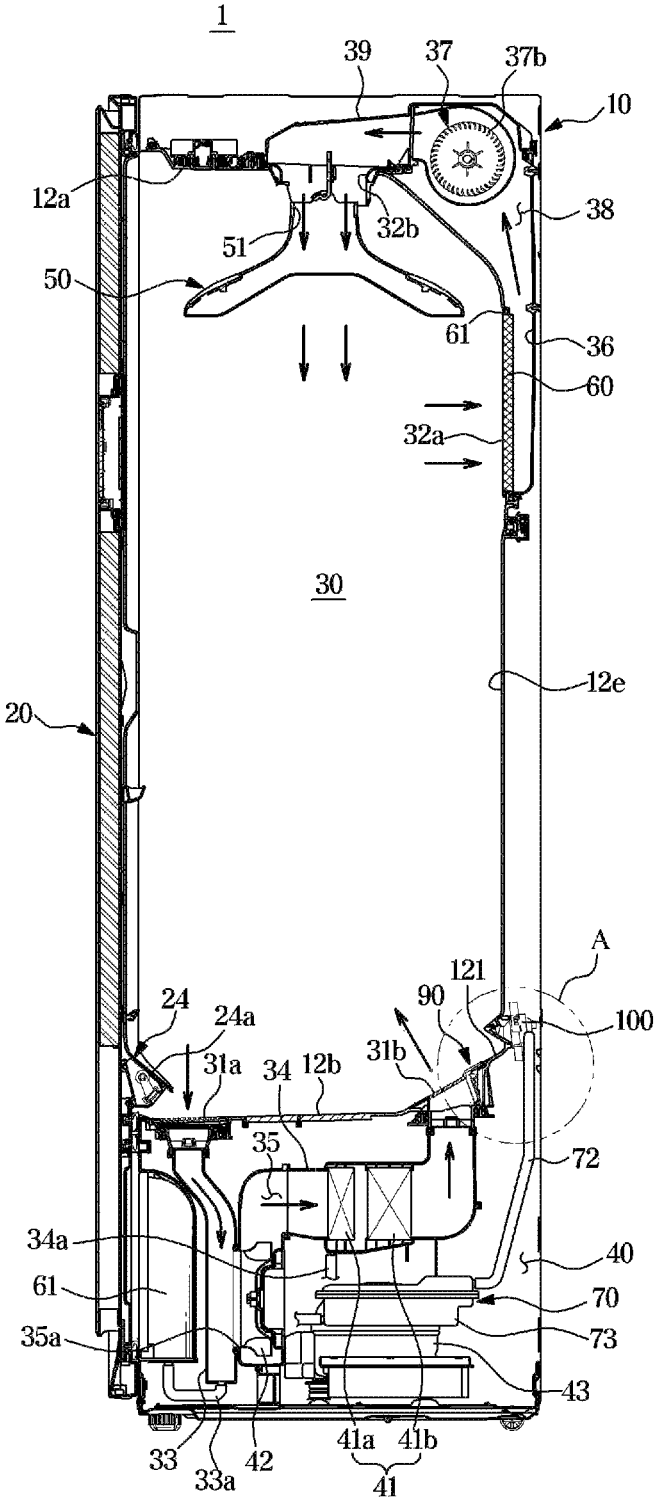
FIG. 3 is a side cross-sectional view of the clothes care apparatus of FIG. 1.
Figure 4:
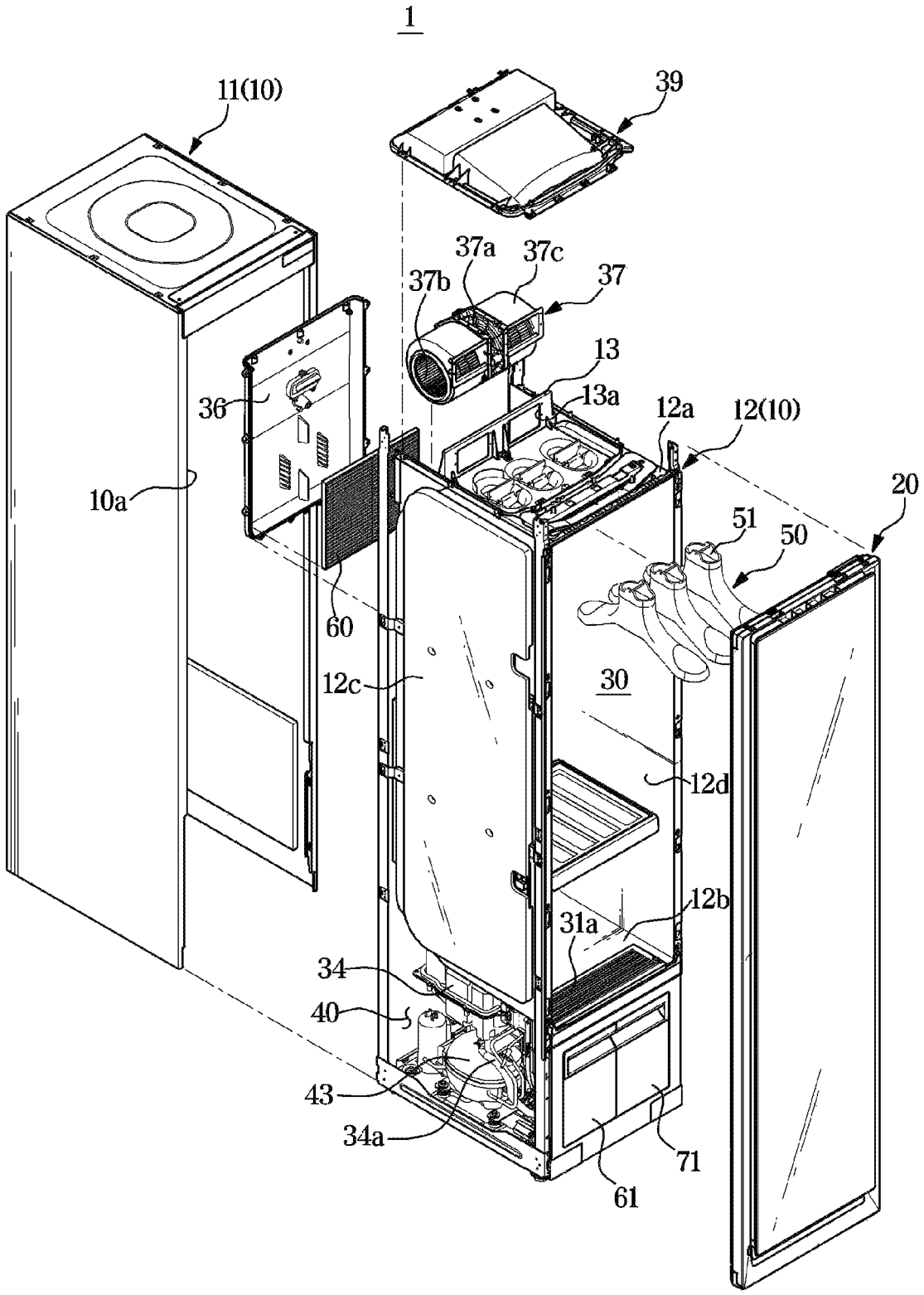
FIG. 4 is an exploded view illustrating the clothes care apparatus of FIG. 1.

FIG. 1 is a view of a clothes care apparatus according to an embodiment of the disclosure. FIG. 2 is a view illustrating a state in which a door of the clothes care apparatus of FIG. 1 is opened. FIG. 3 is a side cross-sectional view of the clothes care apparatus of FIG. 1. FIG. 4 is an exploded view illustrating the clothes care apparatus of FIG. 1.

Referring to FIGS. 1 to 4, a clothes care apparatus 1 may include a body 10 forming an external appearance, a door 20 rotatably coupled to body 10, a clothes care compartment 30 provided inside the body 10 to allow clothes to be placed and to be managed, a clothes support member 50 provided inside the clothes care compartment 30 to allow clothes to be hung thereon, and a machine room 40 provided with a heat exchanger 41 configured to dehumidify or heat air inside the clothes care compartment 30.

The body 10 may have the clothes care compartment 30 formed therein, and may have a hexahedron shape having an open one surface. An opening 10*a* may be formed on the front surface of the body 10.

The door 20 is rotatably coupled to the opening 10*a* of the body 10 to open and close the clothes care compartment 30. Although not shown, the door 20 may be installed through a connecting member such as a hinge and a link.

The body 10 may include an outer cabinet 11 and an inner cabinet 12 arranged inside the outer cabinet 11.

The clothes care compartment 30 forms a space in which clothes are accommodated. The clothes care compartment 30 may include an upper surface 12*a*, a lower surface 12*b*, a left side surface 12*c*, a right side surface 12*d*, and a rear surface 12*e* provided in the inner cabinet 12. The front surface of the clothes care compartment 30 is formed to be open. Therefore, the opening of the clothes care compartment 30 may also be opened and closed by the door 20 configured to open and close the opening 10*a* of the body 10.

The clothes care compartment 30 may include a first airflow inlet 31*a*, a second airflow inlet 32*a*, a first airflow outlet 31*b*, and a second airflow outlet 32*b*.

The first airflow inlet 31*a* and the first airflow outlet 31*b* may be formed on the lower surface 12*b* of the clothes care compartment 30. The first airflow inlet 31*a* may be arranged in front of the lower surface 12*b* of the clothes care compartment 30. The first airflow outlet 31*b* may be arranged behind the lower surface 12*b* of the clothes care compartment 30. The first airflow inlet 31*a* and the first airflow outlet 31*b* may be arranged adjacent to each other.

The second airflow inlet 32*a* may be formed at an upper portion of the rear surface 12*e* of the clothes care compartment 30. The second air flow outlet 32*b* may be formed at a substantially central portion of the upper surface 12*a* of the clothes care compartment 30. The second airflow inlet 32*a* and the second airflow outlet 32*b* may be arranged adjacent to each other.

In the lower portion of the body 10, a water drain tank 61 and a water supply tank 71 removably installed to the body 10 may be installed. The water drain tank 61 and the water supply tank 71 may be arranged under the clothes care compartment 30.

The water drain tank 61 may be configured to easily treat condensed water generated in the clothes care compartment 30. The water drain tank 61 may collect various types of condensed water generated by the clothes care apparatus 1. The water drain tank 61 may be removably mounted to the body 10 so as to easily treat the collected water.

The water supply tank 71 stores water needed for generating steam for the steam generation device 70. Water stored in the water supply tank 71 is supplied to the steam generation device 70 to form steam. The water supply tank 71 may be removably installed to the body 10 to easily supplement water.

The water drain tank 61 and the water supply tank 71 may be provided in front of the machine room 40. The machine room 40 is provided in the lower portion of the body 10. The machine room 40 is provided under the clothes care compartment 30. The machine room 40 may include a heat exchanger 41 configured to dehumidify and heat air in the clothes care compartment 30 as needed.

The heat exchanger 41, a first fan 42, a compressor 43, and the steam generation device 70 may be arranged in the machine room 40.

The heat exchanger 41 is installed to supply hot air into the clothes care compartment 30. The heat exchanger 41 includes an evaporator 41*a* through which a refrigerant circulates and a condenser 41*b*, and the heat exchanger 41 is configured to dehumidify and heat the air.

As the refrigerant evaporates in the evaporator 41*a* of the heat exchanger 41, the refrigerant absorbs latent heat of the ambient air so as to condense and remove moisture in the air. In addition, when the refrigerant is condensed in the condenser 41*b* by the compressor 43, the latent heat is released toward the ambient air to heat the ambient air. That is, the evaporator 41*a* and the condenser 41*b* function as heat exchangers, and the air, which flows into the machine room 40 by the first fan 42, is dehumidified and heated while passing through the evaporator 41*a* and the condenser 41*b* sequentially.

In the machine room 40, ducts 33 and 34 connecting the first airflow inlet 31*a* to the first airflow outlet 31*b* may be arranged. Particularly, the ducts 33 and 34 may include a first duct 33 extending from the first airflow inlet 31*a* and a second duct 34 extending from the first airflow outlet 31*b*.

The first duct 33 may be connected to the first airflow inlet 31*a* of the clothes care compartment 30. The first duct 33 may be connected to the second duct 34. The second duct 34 may be connected to the first air flow outlet 31*b*.

One end of the first duct 33 may be connected to the first airflow inlet 31*a* of the clothes care compartment 30, and the other end of the first duct 33 may be connected to the second duct 34. One end of the second duct 34 may be connected to the first duct 33, and the other end of the second duct 34 may be connected to the first airflow outlet 31*b* of the clothes care compartment 30.

The second duct 34 may accommodate the evaporator 41*a*, the condenser 41*b*, and the first fan 42. As the first duct 33 and the second duct 34 are connected to the clothes care compartment 30, a first circulation flow path 35 configured to circulate among the clothes care compartment 30, the first duct 33, and the second duct 34 may be formed.

A communication port 35*a* through which the first duct 33 and the second duct 34 communicate with each other may be formed at a portion where the first duct 33 and the second duct 34 are connected. The air flowing into the first duct 33 by the first fan 42 may move to the second duct 34 through the communication port 35*a*.

Air in the clothes care compartment 30 may flow into the first circulation flow path 35 through the first airflow inlet 31*a*. The flowing air may be dehumidified and heated by passing through the heat exchanger 41, and the dehumidified and heated air may be discharged to the clothes care compartment 30 again, through the first airflow outlet 31*b*.

According to an embodiment, it is assumed that the first airflow inlet 31*a* is arranged in the front portion of the clothes care compartment 30 and the first airflow outlet 31*b* is arranged in the rear portion of the clothes care compartment 30, but is not limited thereto. Therefore, a location of the airflow inlet and airflow outlet may vary, as needed.

The first duct 33 is provided to dehumidify and heat the air flowing through the first airflow inlet 31*a*, and to discharge the dehumidified and heated air to the first airflow outlet 31*b*. The first fan 42 is installed on the first circulation flow path 35 to suck the air of the clothes care compartment 30 into the first circulation flow path 35.

The machine room 40 may further include the steam generation device 70 configured to generate steam by receiving water from the water supply tank 71. The steam generation device 70 may include a steam generator 73 connected to the water supply tank 71 to receive the water so as to generate steam, and a steam supply pipe 72 configured to guide the generated steam to a steam injector 100. The steam injector 100 may be arranged in a lower portion of the rear surface of the clothes care compartment 30.

A heater (not shown) may be installed inside the steam generator 73 to heat water.

The door 20 may include a door guide 24 guiding the movement of the condensed water. The door guide 24 is configured to guide condensed water formed by condensation on the rear surface of the door 20. The door guide 24 may include a curved portion 24*a* formed to be inclined downward from the rear surface of the door 20 toward the clothes care compartment 30. Accordingly, the condensed water formed on the rear surface of the door 20 may be rolled down by its own weight and then moved to the first airflow inlet 31*a*. The condensed water moved to the first airflow inlet 31*a* may be moved to the water drain tank 61 through a first connecting member 33*a*.

A second connecting member 34*a* may connect the second duct 34 to the first duct 33. As well as condensed water discharged from the steam injector 100, condensed water generated by the heat exchanger 41 may be collected in the second duct 34. The second connecting member 34*a* may guide the condensed water collected in the second duct 34 to the first duct 33. That is, the second connecting member 34*a* may guide the condensed water, which is discharged from the steam injector 100 to the second duct 34, to the first duct 33 while guiding the condensed water, which is generated by the heat exchanger 41, to the first duct 33. The condensed water moved to the first duct 33 may be moved to the water drain tank 61 through the first connecting member 33*a*.

The clothes support member 50 configured to allow clothes to be hung and to be supported, is provided in the clothes care compartment 30. The clothes support member 50 may be installed on the upper surface 12*a* of the clothes care compartment 30. The clothes support member 50 may be removably installed in the clothes care compartment 30. One or more clothes support member 50 may be provided. The clothes support member 50 may be formed in a hanger shape to allow clothes to be hung.

The clothes support member 50 is configured to allow air to flow therein. Dust or foreign substances on the clothes may be removed by the air supplied into the clothes support member 50. The clothes support member 50 may be provided with an air supply port 51 for supplying air to the clothes.

The second airflow outlet 32*b* of the clothes care compartment 30 may communicate with the clothes support member 50. The air discharged through the second airflow outlet 32*b* is delivered to the clothes support member 50 through the air supply port 51 and delivered to the inside of the clothes hung on the clothes support member 50. Alternatively, the air discharged through the second airflow outlet 32*b* is delivered to the clothes support member 50 through the air supply port 51 and discharged to the outside of the air supply port 51 and then delivered to the outside of the clothes.

According to an embodiment, it is assumed that the second airflow outlet 32*b* is arranged above the clothes support member 50, and the air discharged through the second airflow outlet 32*b* is supplied to the inside and the outside of the clothes, but is not limited thereto. For example, the second airflow outlet may be formed in various sizes at various positions to inject air into the clothes in various directions.

The clothes care apparatus 1 may include a second fan 37 configured to move the air of the clothes care apparatus 1.

The clothes care apparatus 1 may include a third duct 36, and the second fan 37 may be installed in the third duct 36. The third duct 36 communicates with the clothes care compartment 30, and accordingly, the clothes care apparatus 1 may include a second circulation flow path 38 configure to allow air to circulate between the clothes care compartment 30 and the third duct 36. The second fan 37 may be arranged on the second circulation flow path 38.

The third duct 36 may be formed behind the second airflow inlet 32*a* of the clothes care compartment 30. The third duct 36 may be provided at the upper rear of the clothes care compartment 30, and may include a filter member 60 therein. The third duct 36 may be coupled to a top cover 39 arranged above the clothes care compartment 30. The third duct 36 may be coupled to the top cover 39 and the second fan 37 may be installed therein.

The second fan 37 may be arranged at the upper rear of the clothes care compartment 30. The second fan 37 may include a blower motor 37*a* generating a rotational force, and at least one fan body 37*b* rotating by the blower motor. The fan body 37*b* may be accommodated by a fan case 37*c*.

The fan case 37*c* may be coupled to a duct bracket 13 provided on the upper surface 12*a* of the clothes care compartment 30. At least one duct hole 13*a* is formed in the duct bracket 13, and the second fan 37 is coupled to the at least one duct hole 13*a* to supply air of the third duct 36 to the second airflow outlet 32*b*.

The third duct 36 may be connected to the second airflow inlet 32*a* and the top cover 39 of the clothes care compartment 30, and the top cover 39 may be connected to the third duct 36 and the second airflow outlet 32*b*.

One end of the third duct 36 may be connected to the second air flow inlet 32*a* of the clothes care compartment 30, and the other end of the third duct 36 may be connected to the top cover 39. One end of the top cover 39 may be connected to the third duct 36 and the other end of the top cover 39 may be connected to the second airflow outlet 32*b*.

By communicating with the clothes support member 50, the second airflow outlet 32*b* may allow a portion of the air delivered from the third duct 36 to be delivered to the clothes support member 50.

The second fan 37 arranged in the third duct 36 sucks air in the clothes care compartment 30 through the second airflow inlet 32*a* and discharges the air to the second airflow outlet 32*b*.

The filter member 60 is installed in the second air flow inlet 32*a* of the clothes care compartment 30. The second airflow inlet 32*a* is formed in the rear surface 12*e* of the clothes care compartment 30. A filter member mounting portion 61 in which the filter member 60 installed is formed on the rear surface 12*e* of the clothes care compartment 30. The second airflow inlet 32*a* may be formed at a position corresponding to the filter member mounting portion 61.

When air in the clothes care compartment 30 flows into the third duct 36, the air may be filtered by the filter member 60 of the second air flow inlet 32*a*. Dust and odor in the air flowing into the third duct 36 may be filtered out by the filter member 60. The air filtered by the filter member 60 may be discharged to the clothes support member 50 by the second fan 37.

The filter member 60 may include a dust collecting filter (not shown) for removing dust or a means for deodorization.

A fragrance sheet 90 may be arranged in a portion of the inner cabinet 12 adjacent to the first airflow outlet 31*b*. The fragrance sheet 90 may be removably coupled to the inner cabinet 12. Air discharged from the first airflow outlet 31*b* may provide a fragrance to the clothes by the fragrance sheet 90.

The clothes care compartment 30 starts the clothes care when the clothes are hung on the clothes support member 50 and the door 20 is closed. In this case, in the clothes care compartment 30, air may be circulated along the first circulation flow path 35 and the second circulation flow path 38.

Figure 5:
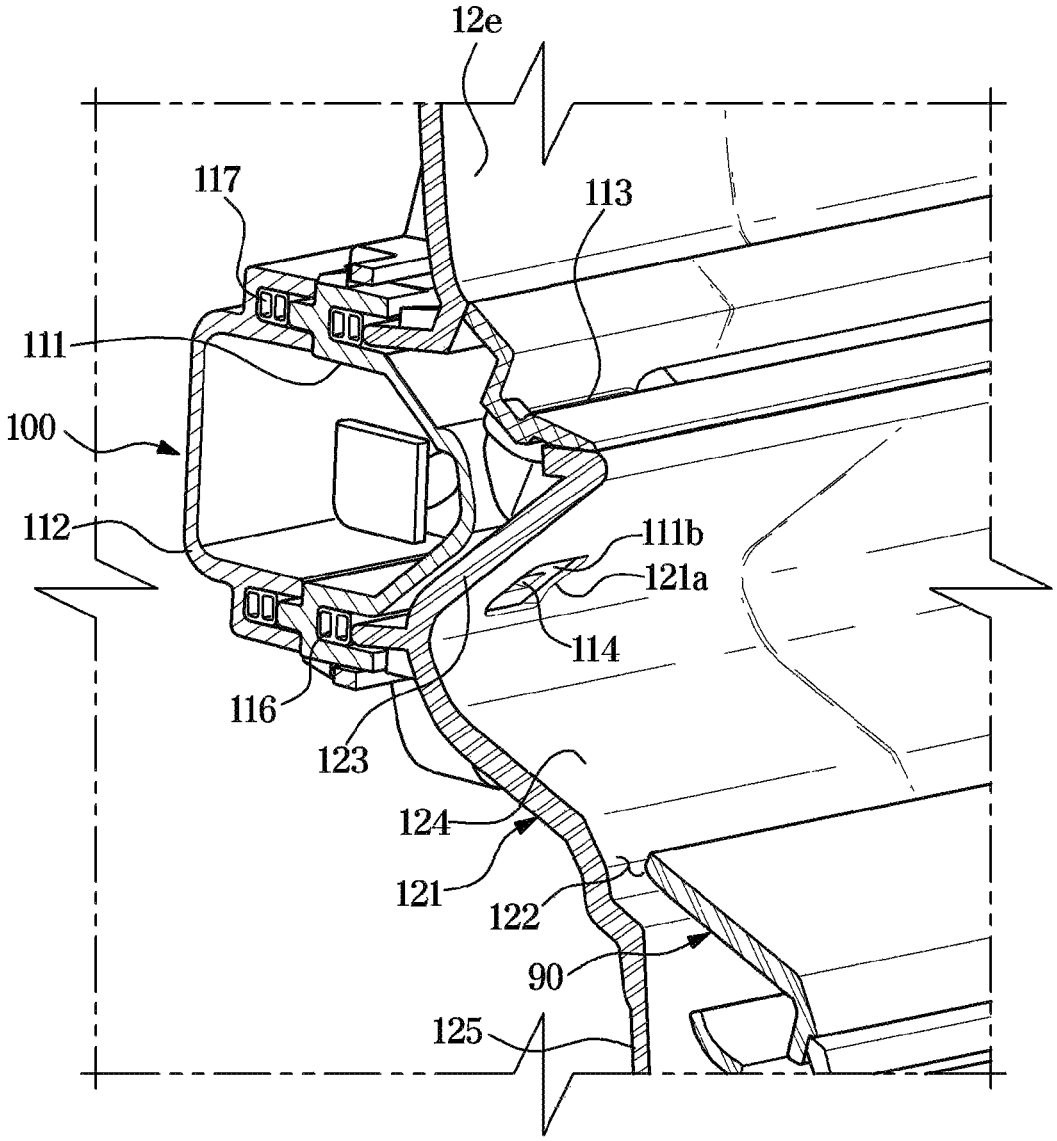
FIG. 5 is a view illustrating a part in which a steam injector of the clothes care apparatus illustrated in FIG. 1 is arranged.
Figure 6:
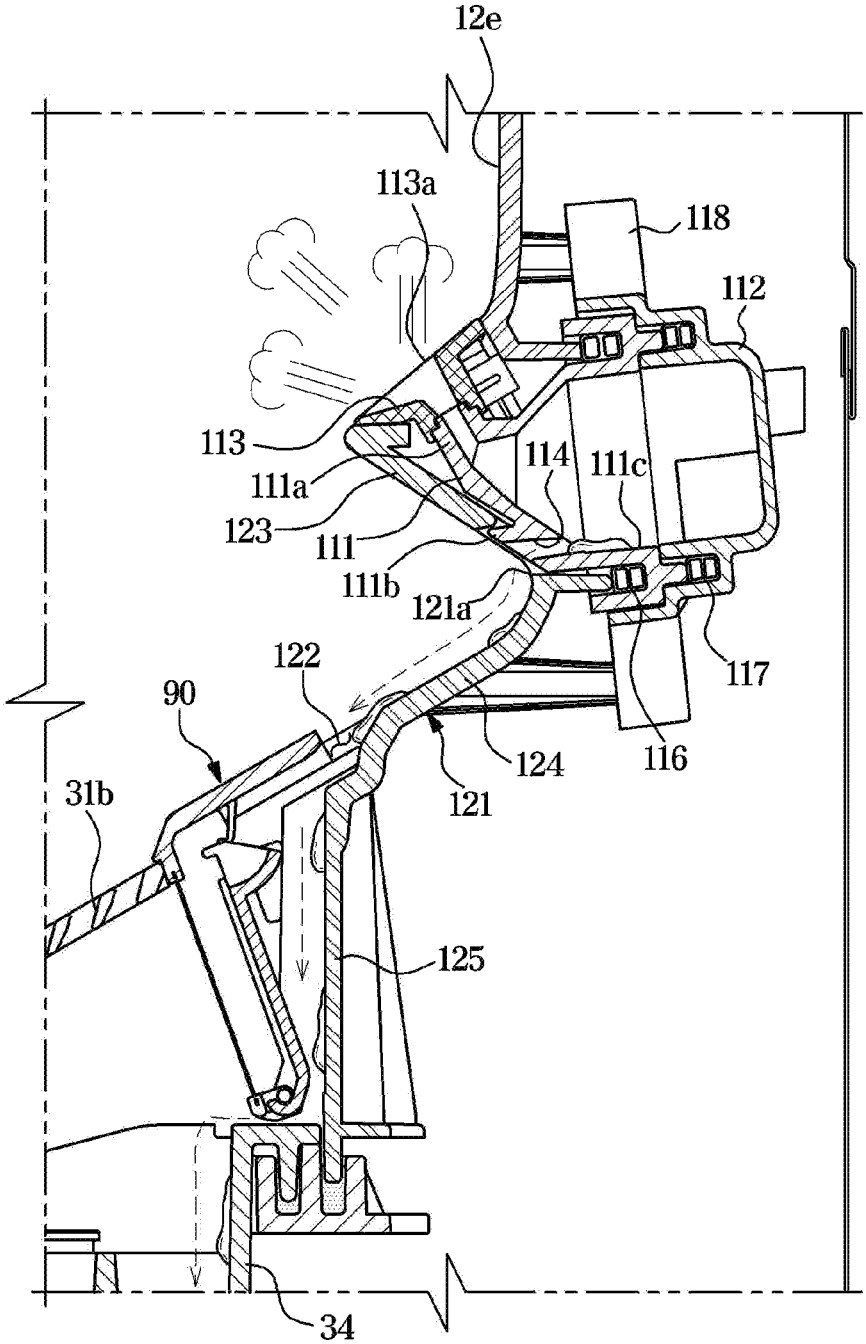
FIG. 6 is an enlarged view of a portion A shown in FIG. 3.
Figure 7:
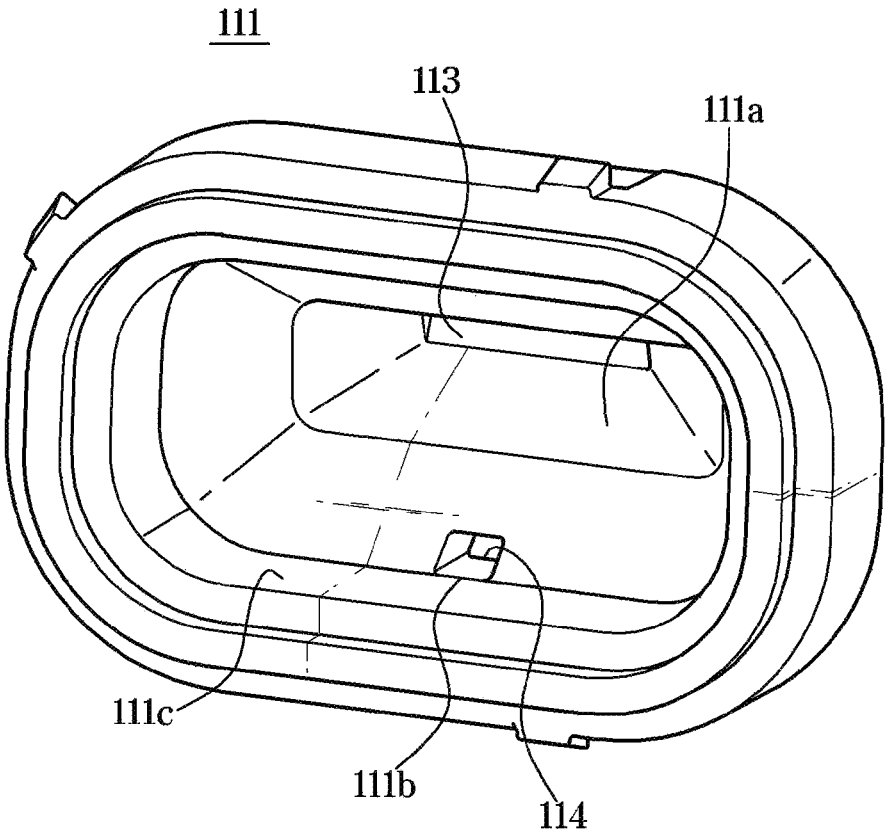
FIG. 7 is a view illustrating an inside of a nozzle member of the steam injector of FIG. 6.
Figure 8:
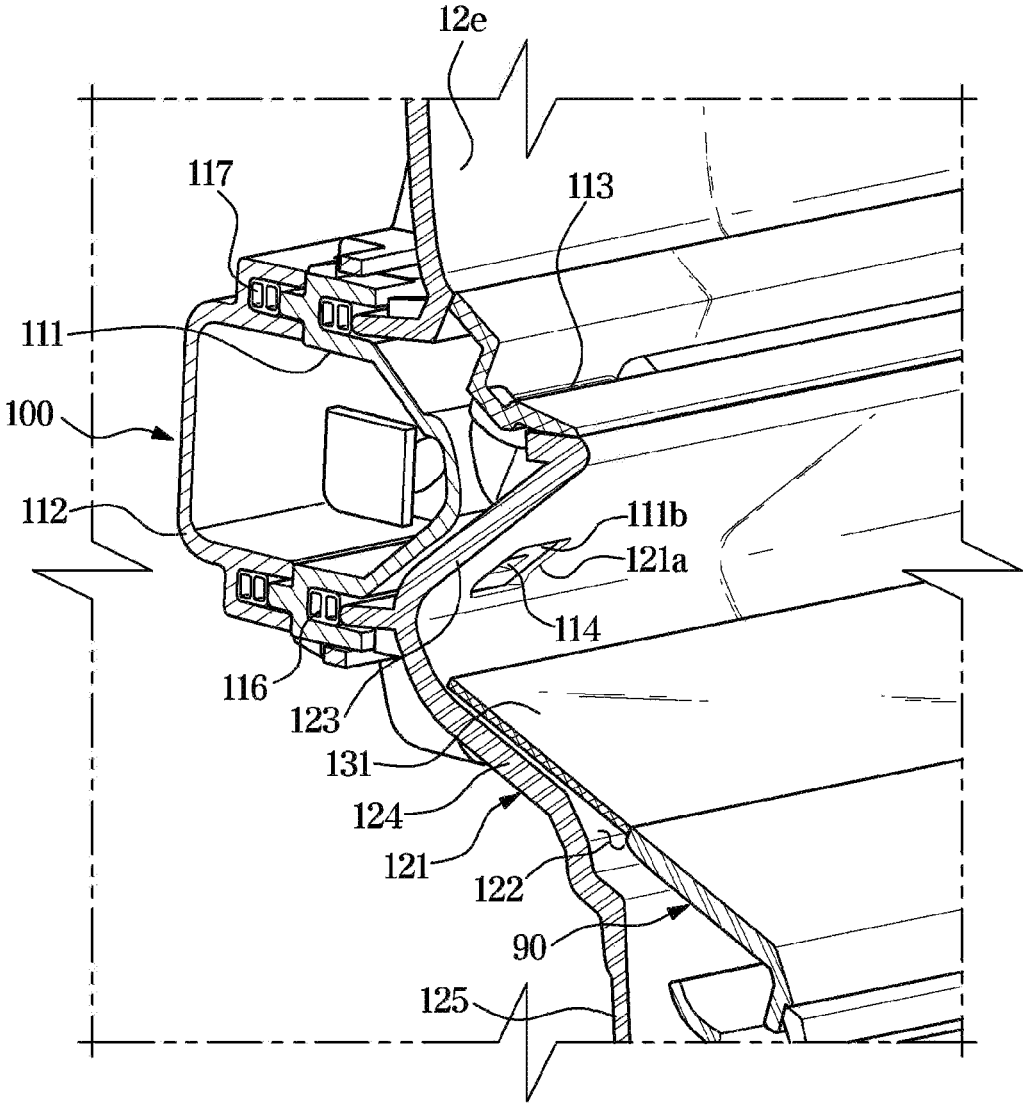
FIG. 8 is a view illustrating a cover member configured to cover a guide plate of FIG. 5.

FIG. 5 is a view illustrating a part in which a steam injector of the clothes care apparatus illustrated in FIG. 1 is arranged. FIG. 6 is an enlarged view of a portion A shown in FIG. 3. FIG. 7 is a view illustrating an inside of a nozzle member of the steam injector of FIG. 6. FIG. 8 is a view illustrating a cover member configured to cover a guide plate of FIG. 5.

Referring to FIG. 5 to FIG. 8, the steam injector 100 may be placed at the rear lower side of the clothes care compartment 30. The steam injector 100 may be configured to inject the steam supplied from the steam generation device 70 into the clothes care compartment 30. The steam injector 100 may be connected to the steam supply pipe 72. The steam injector 100 may include a steam nozzle 111 and a nozzle cover 112.

The steam nozzle 111 may include a steam discharge portion 111*a* injecting steam into the clothes care compartment 30, and a condensed water discharge portion 111*b* discharging condensed water generated by the steam injector 100 to the clothes care compartment 30.

The steam discharge portion 111*a* may extend to face the upper side of the clothes care compartment 30 where the clothing is hung. The steam discharge portion 111*a* may be configured to inject the steam supplied through the steam supply pipe 72 toward the upper side of the clothes care compartment 30. An injection nozzle 113 may be arranged at an end portion of the steam discharge portion 111*a*.

The injection nozzle 113 may be configured to widely inject steam. The injection nozzle 113 may be formed in such a way that the size of the opening increases along a direction in which the steam is injected. A steam injection port 113*a* through which steam is discharged may be formed at an end of the injection nozzle 113.

The condensed water discharge portion 111*b* may be configured to discharge the condensed water to the lower side of the clothes care compartment 30. The condensed water discharge portion 111*b* may be formed to be inclined downward toward the clothes care compartment 30 to allow the condensed water to be discharged by gravity. That is, a bottom surface 111*c* of the injection nozzle 113 may be inclined downward toward the clothes care compartment 30, and the condensed water discharge portion 111*b* may extend downward from the bottom surface 111*c* of the injection nozzle 113.

A condensed water outlet 114 in which the condensed water flows may be formed inside the condensed water discharge portion 111*b*. The condensed water, which is generated from the steam supplied to the steam injector 100, may flow to the condensed water discharge portion 111*b* by its own weight along the bottom surface 111*c*, and then be discharged to the clothes care compartment 30 along the condensed water outlet 114 of the condensed water discharge portion 111*b*.

A first sealing member 116 may be provided at a portion where the steam nozzle 111 and the rear surface 12*e* of the inner cabinet 12 are coupled to each other. By the first sealing member 116, the steam may be prevented from leaking through the portion where the steam nozzle 111 and the inner cabinet 12 are coupled. The first sealing member 116 may be provided at a portion where the steam nozzle 111 and the guide plate 121 are coupled to each other. By the first sealing member 116, the steam may be prevented from leaking through the portion where the steam nozzle 111 and the guide plate 121 are coupled.

The nozzle cover 112 may be configured to cover the rear of the steam nozzle 111. The nozzle cover 112 may include a nozzle fixer 118 fixing the steam injector 100 to the rear of the inner cabinet 12. The nozzle fixer 118 may be fixed to the guide plate 121.

A second sealing member 117 may be provided at a portion where the steam nozzle 111 and the nozzle cover 112 are coupled to each other. By the second sealing member 117, the steam may be prevented from leaking through the portion where the steam nozzle 111 and the nozzle cover 112 are coupled.

The clothes care apparatus 1 may include the guide plate 121 configured to guide the condensed water, which is discharged through the condensed water outlet 114, to the second duct 34 arranged in the machine room 40.

The clothes care apparatus 1 may include a drain hole 122 through which the condensed water, which is discharged through the condensed water outlet 114, flows into the second duct 34 arranged in the machine room 40. The drain hole 122 may allow the clothes care compartment 30 to communicate with the machine room 40.

The guide plate 121 may be mounted in the inner cabinet 12. The guide plate 121 may be arranged adjacent to the drain hole 122. The guide plate 121 may include a seating portion 123 on which the steam injector 100 is seated, a first guide 124 configured to guide condensed water, which is discharged from the condensed water outlet 114, to the drain hole 122, and a second guide 125 configured to guide condensed water, which flows into the machine room 40 through the drain hole 122, to the second duct 34.

The seating portion 123 may be formed to be inclined upward toward the clothes care compartment 30 to allow the steam nozzle 111 of the steam injector 100 to be seated. The seating portion 123 may include a discharge portion insertion hole 121*a* configured to allow the condensed water discharge portion 111*b* of the steam nozzle 111 to be inserted thereinto. The steam nozzle 111 may discharge the condensed water to the drain hole 122 because the condensed water discharge portion 111*b* is inserted into the discharge portion insertion hole 121*a*.

The first guide 124 may be inclined downward from the lower end of the seating portion 123 toward the clothes care compartment 30. The first guide 124 may be inclined downward to allow the condensed water discharged from the condensed water outlet 114 to be moved to the machine room 40 by its own weight. The drain hole 122 thorough which the condensed water flows to the machine room 40 may be arranged at a lower end of the first guide part 124.

The second guide 125 may extend downward from the lower end of the first guide 124. The second guide 125 may extend from the first guide 124 toward the second duct 34. The second guide 125 may guide the condensed water, which flows into the machine room 40 through the drain hole 122, to the second duct 34. The second guide 125 may be coupled to the second duct 34.

According to this configuration, the clothes care apparatus 1 according to an embodiment may guide condensed water of the steam injector 100 to the second duct 34 of the machine room 40 through the condensed water outlet 114 and the drain hole 122 of the steam injector 100, thereby delivering the condensed water to the water drain tank 61, without a separate drainage device configured to deliver the condensed water of the steam injector 100 to the water drain tank 61. Therefore, the clothes care apparatus 1 may effectively discharge the condensed water without a drainage device such as a separate hose, and thus the clothes care apparatus 1 may have a relatively simple configuration.

That is, the clothes care apparatus 1 according to an embodiment may be configured to allow the condensed water, which is generated by the steam injector 100, to sequentially pass through the second duct 34 and the first duct 33 by its own weight, and thus the clothes care apparatus 1 may collect the condensed water, which is generated by the steam injector 100, without a separate complicated device for collecting the condensed water. The condensed water generated by the steam injector 100 may be collected in the first duct 33 together with the condensed water generated elsewhere in the clothes care apparatus 1, and then the condensed water may be moved to the water drain tank 61. Although the clothes care apparatus 1 according to an embodiment is not provided with a device such as a separate hose, which is configured to drain the condensed water and installed at each part where the condensate is generated, the clothes care apparatus 1 may collect the condensed water and store the condensed water in the water drain tank 61 by using a relatively simple configuration, thereby reducing the manufacturing cost.

The clothes care apparatus 1 may further include a plate cover 131 covering at least a portion of the guide plate 121 through which condensed water flows. The plate cover 131 may prevent the condensed water flowing along the guide plate 121 from being exposed to the user. The plate cover 131 may be removably mounted to the guide plate 121. By the cover plate 131, the clothes care apparatus 1 may prevent an unpleasant feeling that the user can feel.

Figure 9:
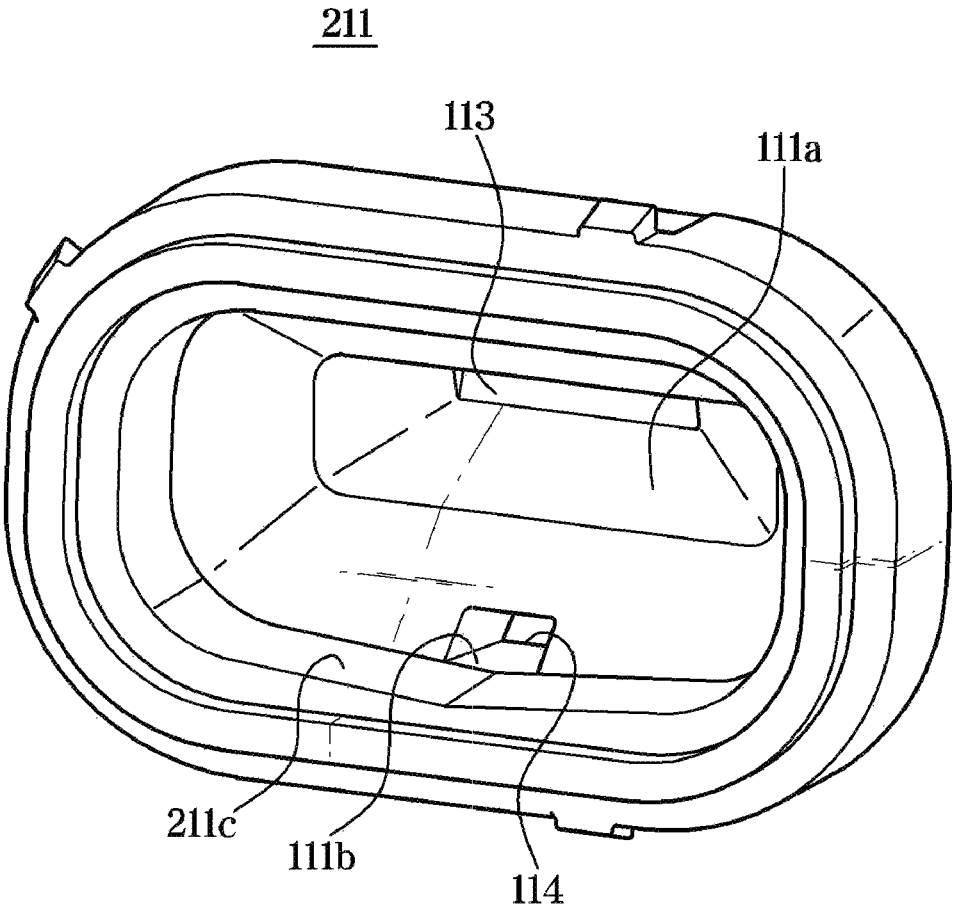
FIG. 9 is a view illustrating an embodiment of a steam nozzle of FIG. 7.

FIG. 9 is a view illustrating an embodiment of a steam nozzle of FIG. 7.

Hereinafter a description of the same parts as those described above will be omitted.

Referring to FIG. 9, a steam nozzle 211 according to an embodiment may be formed in such a way that a bottom surface 211*c* is inclined downward toward a condensed water discharge portion 111*b*.

The bottom surface 211*c* of the steam nozzle 211 may be inclined downward toward the condensed water discharge portion 111*b* so as to effectively guide the condensed water, which is generated by the steam injector 100, to the condensed water discharge portion 111*b*. That is, the bottom surface 211*c* of the steam nozzle 211 may be inclined downward toward the clothes care compartment 30 along the direction in which the condensed water discharge portion 111*b* extends, and at the same time, the bottom surface 211*c* of the steam nozzle 211 may be inclined to guide the condensed water to the center portion of the steam nozzle 211. The bottom surface 211*c* of the steam nozzle 211 may have V-shape when viewed from the rear side.

According to this configuration, the steam nozzle 211 according to an embodiment may efficiently discharge the condensed water.

Figure 10:
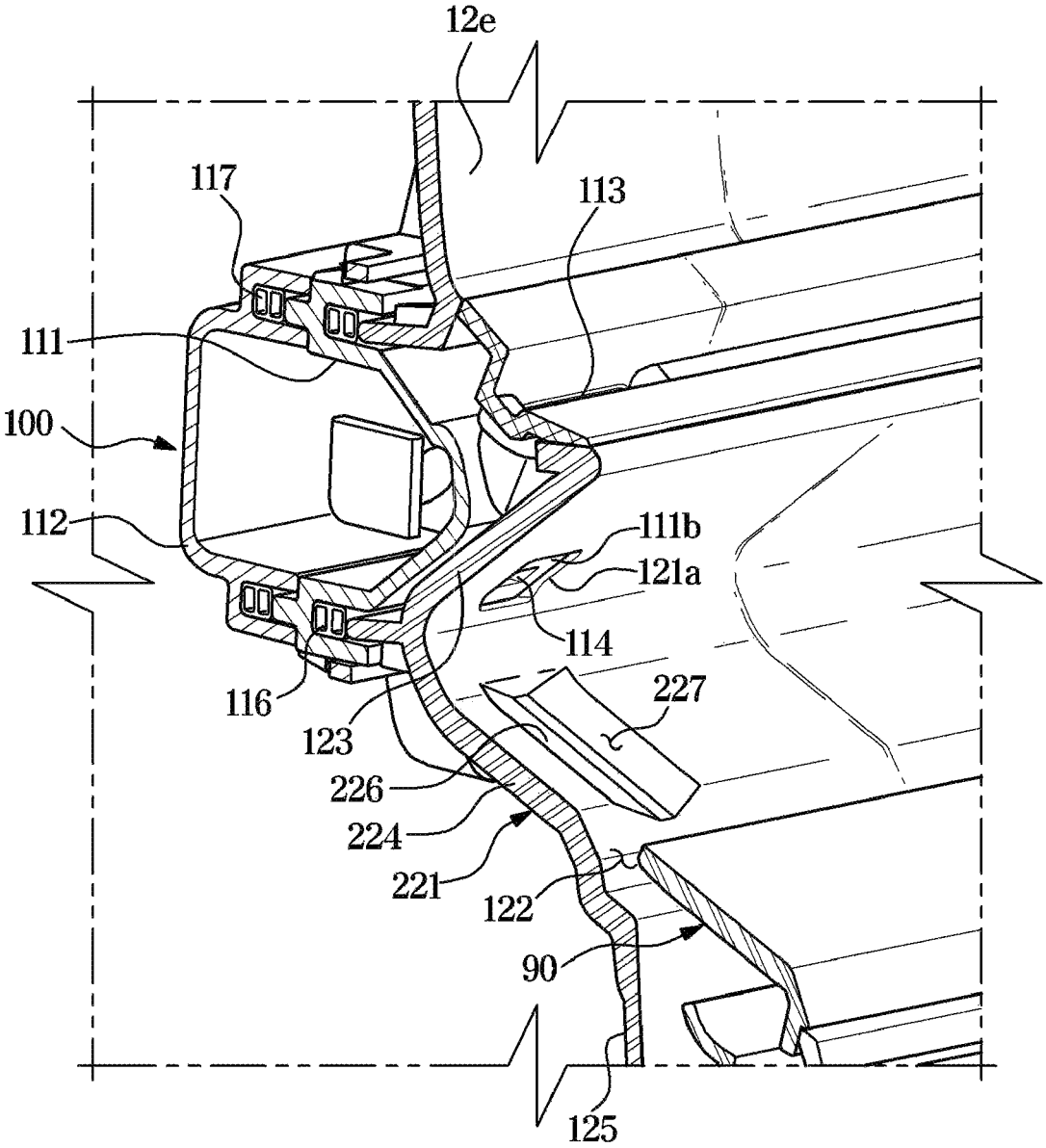
FIG. 10 is a view illustrating an embodiment of the guide plate of FIG. 5.

FIG. 10 is a view illustrating an embodiment of the guide plate of FIG. 5.

Hereinafter a description of the same parts as those described above will be omitted.

Referring to FIG. 10, a guide plate 221 may include a guide groove 226 formed in a first guide 224.

The guide groove 226 may be configured to efficiently guide condensed water, which is discharged from the condensed water outlet 114, to the drain hole 122. The guide groove 226 may be recessed in the first guide 224. The guide groove 226 may extend along the direction in which the condensed water flows. The guide groove 226 may be arranged at a position corresponding to the condensed water outlet 114. The guide groove 226 may form a water channel 227 through which condensed water flows.

According to this configuration, the guide plate 221 according to an embodiment may efficiently guide the condensed water to the drain hole 122.

Figure 11:
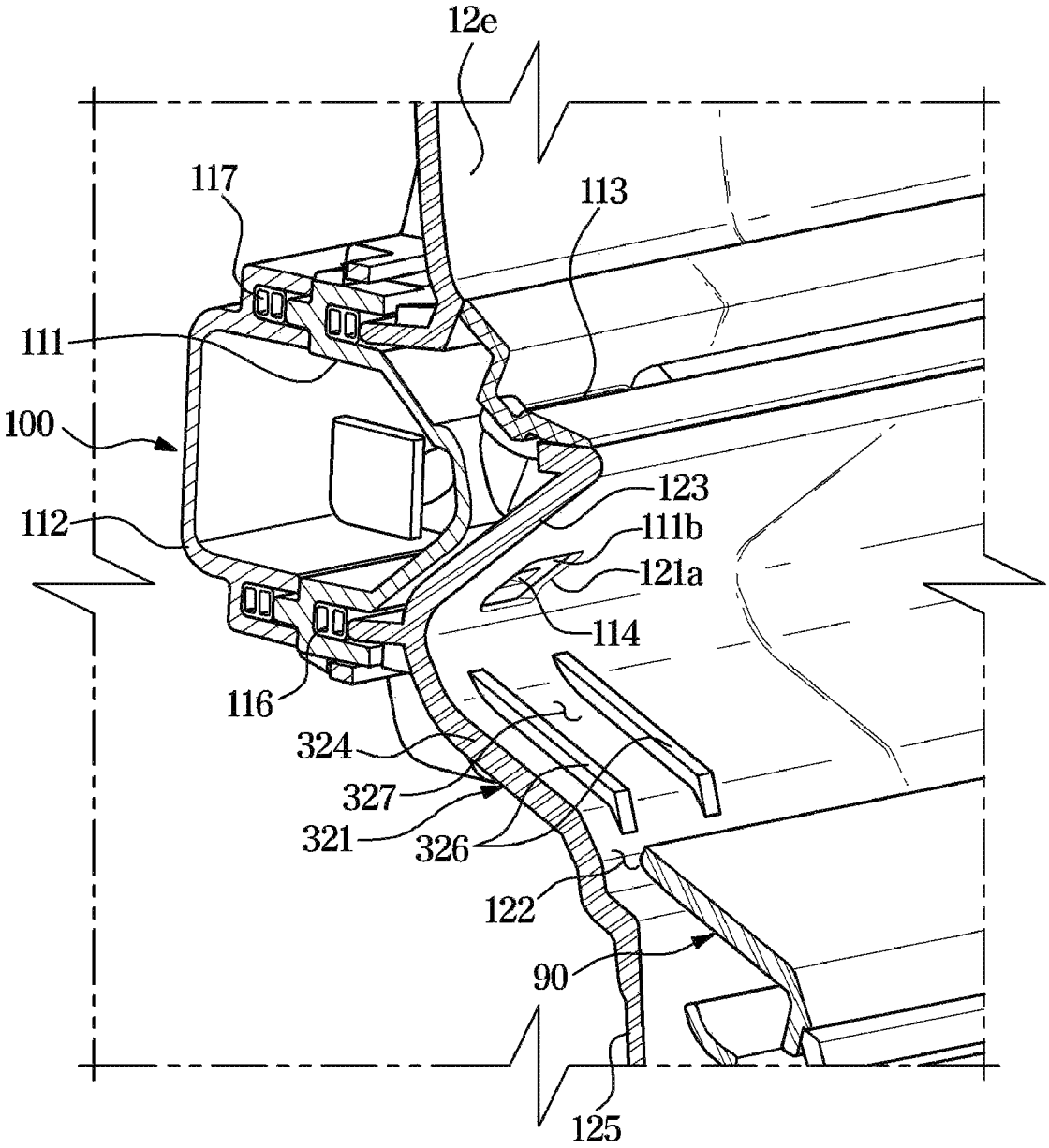
FIG. 11 is a view illustrating an embodiment of the guide plate of FIG. 5.

FIG. 11 is a view illustrating an embodiment of the guide plate of FIG. 5.

Hereinafter a description of the same parts as those described above will be omitted.

Referring to FIG. 11, a guide plate 321 may include a guide rib 326 formed in a first guide 324 and a water channel 327 formed between the guide ribs 326.

The guide rib 326 may be configured to efficiently guide condensed water, which is discharged from the condensed water outlet 114, to a drain hole 122. The guide rib 326 may protrude from the first guide 324. Two guide ribs 326 may be provided to form the water channel 327. The guide rib 326 may extend along a direction in which the condensed water, which is discharged from the condensed water outlet 114, flows.

The water channel 327 may be formed between the guide ribs 326. The guide rib 326 may be arranged to form the water channel 327 at a position corresponding to the condensed water outlet 114. The water channel 327 may guide the condensed water, which is discharged from the condensed water outlet 114, to the drain hole 122.

According to this configuration, the guide plate 321 according to an embodiment may efficiently guide the condensed water to the drain hole 122.

As is apparent from the above description, the clothes care apparatus includes a drain hole formed to guide the condensed water, which is discharged from a steam injector to a clothes care compartment, to a duct of a machine room connected to a water drain tank, and thus it is possible to collect condensed water, which is generated by the steam injector, by using a relatively simple configuration.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes care apparatus comprising:

a body comprising a clothes care compartment and a machine room arranged under the clothes care compartment;

a steam generation device configured to generate steam;

a steam injector comprising a steam injection port configured to receive the steam from the steam generation device and inject the steam into an inside of the clothes care compartment, and a condensed water outlet configured to discharge condensed water from the steam injector into the inside of the clothes care compartment; and a drain hole provided in the clothes care compartment below the condensed water outlet to connect the clothes care compartment to the machine room to allow the condensed water discharged from the condensed water outlet to flow into the machine room.

2. The clothes care apparatus of claim 1, further comprising:

a guide plate provided in the clothes care compartment below the condensed water outlet to guide the condensed water discharged from the condensed water outlet to the drain hole.

3. The clothes care apparatus of claim 1, wherein the condensed water outlet is inclined downward toward the clothes care compartment.

4. The clothes care apparatus of claim 3, wherein the steam injector comprises a bottom surface inclined downward toward the clothes care compartment.

5. The clothes care apparatus of claim 1, wherein the steam injector comprises a steam nozzle in which the steam injection port and the condensed water outlet are formed;

a nozzle cover coupled to the steam nozzle; and a first sealing member arranged between the steam nozzle and the nozzle cover.

6. The clothes care apparatus of claim 1, wherein the steam injection port is arranged above the condensed water outlet.

7. The clothes care apparatus of claim 2, wherein the guide plate comprises a first guide inclined downward toward the drain hole and configured to guide the condensed water discharged from the condensed water outlet to the drain hole; and a second guide configured to guide the condensed water from the drain hole to a duct arranged inside the machine room.

8. The clothes care apparatus of claim 7, wherein the duct comprises a first duct connected to a first airflow inlet into which the air of the clothes care compartment flows into the first duct, and a second duct connected to the first duct and to a first airflow outlet configured to discharge the air from the second duct to the clothes care compartment.

9. The clothes care apparatus of claim 8, wherein the duct comprises a communication port configured to connect the first duct to the second duct; and a connecting member to connect the first duct to the second duct to drain condensed water from the second duct to the first duct.

10. The clothes care apparatus of claim 9, further comprising:

a water drain tank arranged inside the machine room and connected to the first duct to collect condensed water from the first duct.

11. The clothes care apparatus of claim 8, wherein a first end of the guide plate is coupled to the steam injector and a second end of the guide plate is coupled to the second duct.

12. The clothes care apparatus of claim 1, further comprising:

a sealing member arranged between the steam injector and the body.

13. The clothes care apparatus of claim 2, wherein the guide plate comprises a recessed guide groove to form a water channel configured to guide the condensed water discharged from the condensed water outlet to the machine room.

14. The clothes care apparatus of claim 2, wherein the guide plate comprises a plurality of protruding guide ribs to form a water channel configured to guide the condensed water discharged from the condensed water outlet to the machine room.

15. The clothes care apparatus of claim 2, further comprising:

a plate cover configured to cover a flow of the condensed water in the guide plate.

16. A clothes care apparatus comprising:

a body comprising a clothes care compartment, a machine room arranged under the clothes care compartment, and a drain hole provided in the clothes care compartment below the condensed water outlet to connect the clothes care compartment to the machine room;

a steam generation device configured to generate steam;

a steam injector comprising a steam injection port configured to receive the steam from the steam generation device and inject the steam into an inside of the clothes care compartment, and a condensed water outlet configured to discharge condensed water, which is generated by the steam injector, into the inside of the clothes care compartment; and a guide plate provided below the condensed water outlet and comprising a first guide configured to guide the condensed water discharged from the condensed water outlet to the drain hole.

17. The clothes care apparatus of claim 16, wherein the condensed water outlet is inclined downward toward the clothes care compartment.

18. The clothes care apparatus of claim 16, further comprising a duct arranged in the machine room and configured to circulate air in the clothes care compartment, wherein the guide plate further comprises a second guide configured to extend from the first guide to the duct.

19. The clothes care apparatus of claim 18, further comprising:

a water drain tank connected to the duct and arranged in the machine room to collect condensed water from the duct.

20. A clothes care apparatus comprising:

a body comprising a clothes care compartment and a machine room arranged under the clothes care compartment;

a steam generation device configured to generate steam;

a steam injector configured to receive the steam from the steam generation device and to inject the steam into an inside of the clothes care compartment;

a duct arranged in the machine room and configured to circulate air in the clothes care compartment; and a guide plate provided in the clothes care compartment below the steam injector and configured to guide condensed water discharged from the steam injector to the duct.

* * * * *